US007215275B2

(12) United States Patent
Dumas

(10) Patent No.: US 7,215,275 B2
(45) Date of Patent: May 8, 2007

(54) INDEPENDENT TEMPERATURE AND APPARENT COLOR CONTROL TECHNOLOGY FOR ADAPTIVE CAMOUFLAGE

(75) Inventor: Jean Dumas, Québec (CA)

(73) Assignee: Her Majesty the Queen as represented by the Minister of National Defence of Her Majesty's Canadian Government, Ontario (CA)

( * ) Notice: Subject to any disclaimer, the term of this patent is extended or adjusted under 35 U.S.C. 154(b) by 184 days.

(21) Appl. No.: 11/000,034

(22) Filed: Dec. 1, 2004

(65) Prior Publication Data

US 2007/0035435 A1 Feb. 15, 2007

Related U.S. Application Data

(60) Provisional application No. 60/527,005, filed on Dec. 5, 2003.

(51) Int. Cl.

| | |
|---|---|
| ***F41H 3/00*** | (2006.01) |
| ***H01Q 17/00*** | (2006.01) |
| ***B63G 13/02*** | (2006.01) |
| ***B63G 8/34*** | (2006.01) |
| *G01S 13/00* | (2006.01) |

(52) U.S. Cl. ..... 342/3; 342/1; 342/2; 342/4; 342/13; 342/14; 114/15

(58) Field of Classification Search ..... 114/15; 342/1–4, 13, 14, 16; 340/919, 927; 40/463–476, 40/493–507

See application file for complete search history.

(56) References Cited

U.S. PATENT DOCUMENTS

| | | | | |
|---|---|---|---|---|
| 1,463,108 | A * | 7/1923 | Willison et al. | 40/505 |
| 1,466,776 | A * | 9/1923 | White | 40/505 |
| 1,551,541 | A * | 9/1925 | Collins | 340/927 |
| 1,603,938 | A * | 10/1926 | Dobbins | 40/473 |
| 2,388,646 | A * | 11/1945 | Ryan | 40/505 |
| 3,304,638 | A * | 2/1967 | Grandell et al. | 40/505 |
| 3,367,049 | A * | 2/1968 | Noreen | 40/505 |
| 6,927,724 | B2 * | 8/2005 | Snaper | 342/3 |

* cited by examiner

*Primary Examiner*—Bernarr E. Gregory
(74) *Attorney, Agent, or Firm*—Stites & Harbison PLLC; Ross F. Hunt, Jr.

(57) ABSTRACT

An apparatus for adaptive camouflage with independent control of both temperature and apparent color. The apparatus has cells or individual pixels behind a transparent outer layer. The temperature of the outer layer is controlled by a heat transfer fluid flowing in a closed circuit in each cell, the fluid being cooled or heated by Pelletier elements located behind the assembly. Color changes can be activated separately at the back of the transparent layer by the rotation of metallic triangles whose sides are covered with various color paints, the triangles being located behind the transparent layer. Radar absorption is obtained by the transparent layer and heat transfer fluid and by the selective orientation of the metallic triangles in various directions. The apparent signature of the assembly can then be varied by adapting the signature of the various cells to current environmental conditions when background conditions alter.

11 Claims, 2 Drawing Sheets

INDEPENDENT TEMPERATURE AND APPARENT COLOR CONTROL TECHNOLOGY FOR ADAPTIVE CAMOUFLAGE

This Claims benefit of Provisional Application Ser. No. 60/527,005 filed on 5 Dec. 2003.

FIELD OF THE INVENTION

The present invention relates to an adaptive Camouflage device that can provide simultaneous signature matching in several spectral bands.

BACKGROUND OF THE INVENTION

One method to increase the military's chances of survival on the battlefield is to use camouflage techniques. Sensor technology, however, has improved tremendously during the last few years and effective signature management methods need to be used simultaneously in several spectral bands. Modern camouflage systems should, therefore, be capable of reducing signatures to a level similar to that of the background and particularly in the visual, infrared and radar bands simultaneously. Furthermore, background features are not stable and actual camouflage means are generally statistical averages for reducing a signature in most cases.

There are no techniques or materials, at present, which are capable of producing a "chameleon" effect in several spectral bands. Current camouflage materials are capable of producing acceptable close to background level in visual, infrared and radar bands. They cannot, however, change so as to match different environmental conditions simultaneously to acceptable levels. Some materials exist that can change their properties in one particular spectral band, for example, a change of colour in the visual band but cannot change in other spectral bands. No known material, up to present exist that allow for simultaneous signature matching in the visual, infrared and radar bands.

SUMMARY OF THE INVENTION

It is an object of the present invention to provide a camouflage device that allows for simultaneous acceptable signature matching in several different spectral bands.

An adaptive camouflage device according to the present invention comprises a panel having rows and columns of selectively rotatable elements with outer surfaces of the elements being covered with bands of various colours, said bands being parallel to an axis of the rotatable element, the elements being located behind a transparent layer whereby on rotation of the elements various colour combination are observable through said transparent layer, a heat transfer fluid being located between the transparent layer and the rotatable elements, which fluid is in contact with Peltier elements to adjust the temperature of the fluid.

BRIEF DESCRIPTION OF THE DRAWINGS

A preferred embodiment of the invention will now be described in more detail with reference to the accompanying drawings in which.

BRIEF DESCRIPTION OF A PREFERRED EMBODIMENT

One of the methods to increase the military's chances of survival on the battlefield is to use camouflage techniques. Sensor technology, however, has improved tremendously over the last few years and effective signature management methods now need to be used simultaneously in several spectral bands. Modern camouflage systems should, therefore, be capable of reducing signatures to a level similar to that of the background and particularly in the visual, infrared and radar bands. Background feature are not stable, however, and actual camouflage means are generally statistical averages for reducing signatures in most cases.

Figure 1:
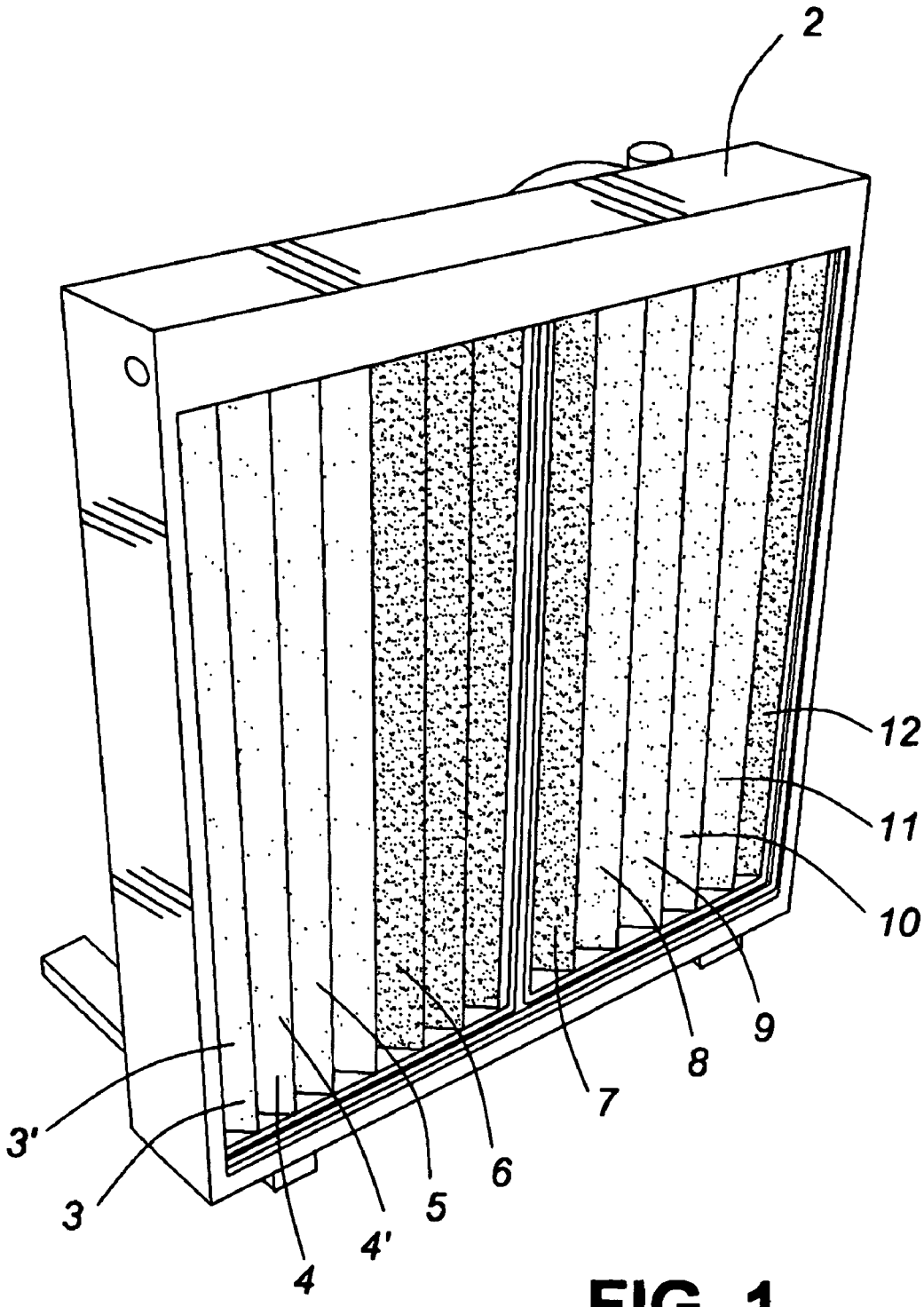
FIG. 1 is a front view of an adaptive panel according to the present invention where colours can be selectively exhibited at the surface of the panel and its infrared emission can be selectively altered.

There has not been, up to present, any techniques or materials that are capable of producing a "chameleon" effect in several spectral bands. FIG. 1 is a front view of an adaptive panel according to the present invention where three separate colours can be selectively exhibited at the surface of panel and its infrared emission can simultaneous be selectively altered.

Figure 2:
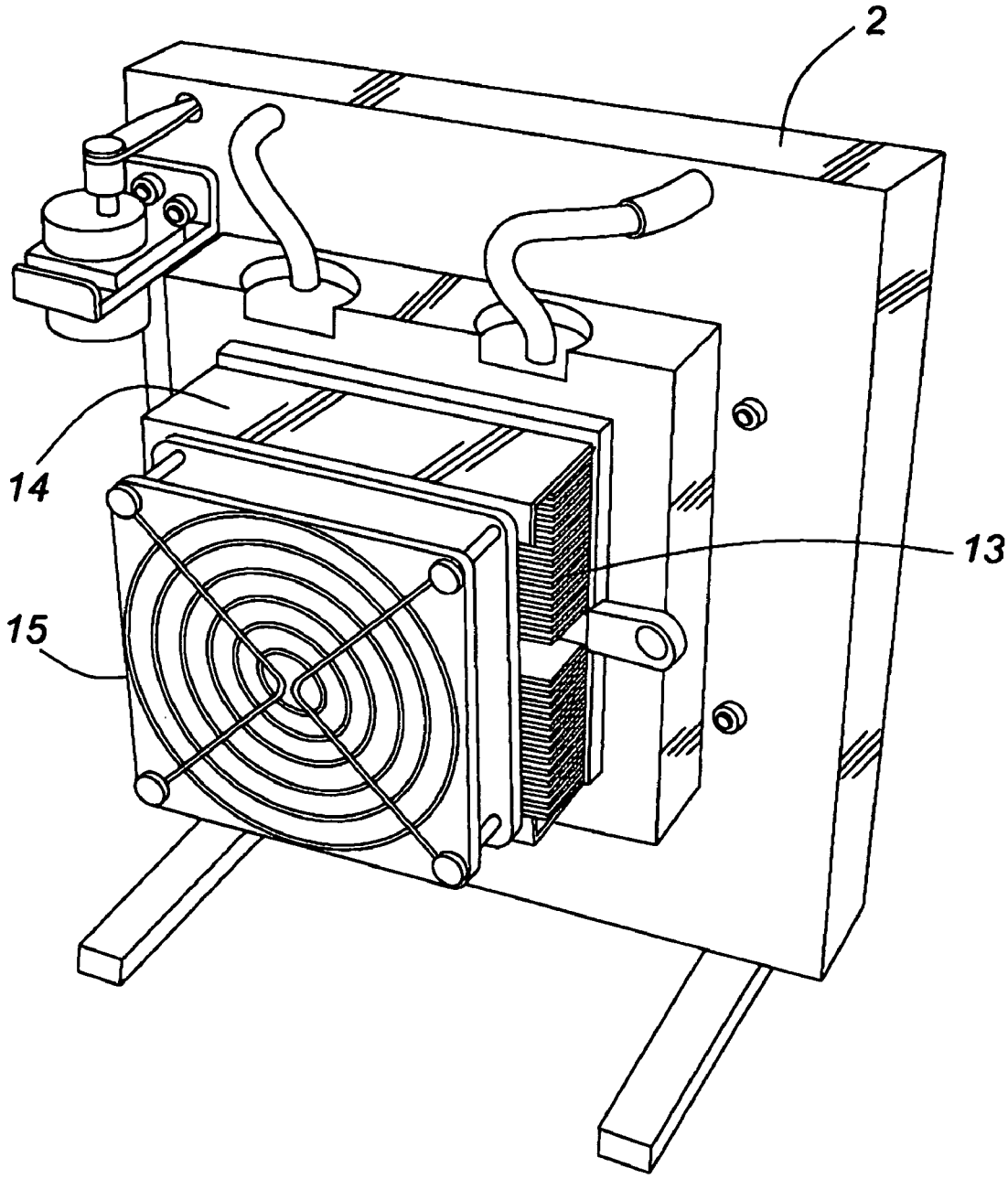
FIG. 2 is a back view of the panel shown in FIG. 1.

To obtain an adequate "chameleon" effect at the surface of the panel 2 shown in FIG. 1 and produce a programmable camouflage pattern in all spectral bands of interest, cells 3,3',4,4' and those in columns 5 to 12 in that panel 2 must be divided into easily controlled compartments or individual pixels. Each cell 3,3',4,4' and those in columns 5 to 12 can then be programmed individually to a visual, infrared or radar level according to current environmental conditions when the background features change. It is then possible to make isolated changes in the panel's signature but a "sandwich" type approach must be applied for each of the spectral bands in addition to a judicious use of transparency and opacity features. For the outer layer of the panel, a transparent material (not shown) is used and its temperature is controlled with a heat transfer fluid flowing in a closed circuit in each cell. The fluid is cooled and heated, as applicable, by Peltier elements 13 located behind the assembly. Those Peltier elements 13 are also arranged in rows and columns and are shown in the back view of the panel in FIG. 2 along with a fan 15 behind the Peltier elements to adjust the temperature of the Peltier elements. An apparent change in temperature can be obtained by these means. At the same time, colour changes can be activated separately by triangular cross-sectional shaped elements at the back of the transparent layer by the rotation of the metallic triangles whose sides are covered with various coloured paints. Those triangular elements are arranged in rows and columns and can be activated individually or as a group to form various colour combinations. Radar absorption is performed by the transparent layer and heat transfer liquid and the emission coefficient can subsequently be controlled separately by skilful orientation of the metallic triangles in various directions i.e. by placing their edges next to the transparent layer. By orienting the metallic triangles separately, it is then possible to adapt the signature of the cells as a whole to the current environmental conditions. In addition, use of various paints combined with radar absorption materials with various radar absorption coefficients can also contribute to radar signature modification of the system.

These cells are compatible with a military environment since they have a very resistant outer surface. Furthermore, each unit is completely independent and only needs electrical power.

Various modifications may be made to the preferred embodiment without departing from the spirit and scope of the invention as defined in the appended claims.

The triangular shaped elements could, for instance, have other shapes including cylinders as long as bands on the outer surface have various colours and the bands are parallel to the axis of the rotatable elements.

The embodiment of the invention in which an exclusive property or privilege is claimed are defined as follows:

1. An adaptive camouflage device comprising a panel having rows and columns of elements, each element having a triangular cross-sectional shape, each side of the elements being covered with different colour paints, the elements being selectively rotatable behind a transparent layer to provide various colour combinations observable through the transparent layer, a heat transfer fluid being located behind the transparent layer which fluid is in contact with Peltier elements to control the temperature of the fluid, the Peltier elements being located at the back of the panel.

2. An adaptive camouflage device as defined in claim 1, wherein a fan is located behind the Peltier elements to transfer the Peltier element's temperatures to an environment behind the panel.

3. An adaptive camouflage device as defined in claim 2, wherein radar absorption by the panel is performed by the transparent layer and heat transfer fluid and rotation of the triangular elements.

4. An adaptive camouflage device as defined in claim 2, wherein the paints include radar absorption materials.

5. An adaptive camouflage device as defined in claim 1, wherein radar absorption by the panel is performed by the transparent layer and heat transfer fluid and rotation of the triangular elements.

6. An adaptive camouflage device as defined in claim 1, wherein the paints include radar absorption materials.

7. An adaptive camouflage device comprising a panel having rows and columns of selectively rotatable elements with outer surfaces of the elements being covered with bands of various coloured paints, said bands being parallel to an axis of the rotatable elements, the elements being located behind a transparent layer whereby on rotation of the elements various colour combination are observable, through said transparent layer, heat transfer fluid being located between the transparent layer and the rotatable elements, which fluid is in contact with Peltier elements to adjust the temperature of the fluid.

8. An adaptive camouflage device as defined in claim 7, wherein radar absorption by the panel is performed by the transparent layer and heat transfer fluid and rotation of the rotatable elements.

9. An adaptive camouflage device as defined in claim 8, wherein a fan is located near the Peltier elements on a side remote from the transparent layer to transfer the Peltier element's temperature to an environment behind the panel.

10. An adaptive camouflage device as defined in claim 9, wherein the paints include radar absorption material.

11. An adaptive camouflage device as defined in claim 8, wherein the paints include radar absorption material.

* * * * *